United States Patent [19]

Manthey et al.

[11] 4,036,243

[45] July 19, 1977

[54] APPARATUS FOR COOLING HOT SLABS

[75] Inventors: Willi Manthey, Duisburg; Horst Deiwick, Krefeld-Gartenstadt, both of Germany

[73] Assignee: BWG Bergwerk-und Walzwerk Maschinenbau G.m.b.H., Duisburg, Germany

[21] Appl. No.: 702,587

[22] Filed: July 6, 1976

[30] Foreign Application Priority Data

July 7, 1975 Germany ..... 2530237

[51] Int. Cl.[2] ..... B08B 3/04

[52] U.S. Cl. ..... 134/76; 134/133; 72/201; 266/132

[58] Field of Search ..... 134/76, 77, 133, 134; 266/132; 72/201

[56] References Cited

U.S. PATENT DOCUMENTS

| | | | |
|---|---|---|---|
| 1,919,136 | 7/1933 | Smith | 266/132 X |
| 2,933,032 | 4/1960 | Pardee | 134/76 |
| 3,680,344 | 8/1972 | Manthey et al. | 72/201 |
| 3,895,498 | 7/1975 | Manthey et al. | 134/76 X |

*Primary Examiner*—Robert L. Bleutge
*Attorney, Agent, or Firm*—Karl F. Ross; Herbert Dubno

[57] ABSTRACT

Rows of stakes rising from several parallel beams in a soaking pit form a multiplicity of compartments each designed to receive one or more slabs coming to rest on a pair of such beams. The slabs are carried hot to the pit and cold from the pit by a railborne transporter including a traverse provided with two sets of fixed vertical guide bars hanging down between the rows of stakes, these sets being separated in the direction of travel by twice the stake spacing and flanking an array of vertically reciprocable gripper arms lowerable to the level of the beams between the rows of stakes. The gripper arms, mounted on carriages guided by the bars, define with them two carrying cages, alignable with a pair of adjacent pit compartments, and are provided with retractable feet that can be alternately extended across the bottom of one or the other cage for supporting a hot slab to be deposited in one compartment and then extracting a cooled slab from the adjoining compartment.

11 Claims, 6 Drawing Figures

APPARATUS FOR COOLING HOT SLABS

FIELD OF THE INVENTION

Our present invention relates to an apparatus for cooling hot metal slabs, referred to hereinafter as slabs, by immersing them in a suitable fluid, generally water, within a soaking pit forming a multiplicity of slab-receiving compartments.

BACKGROUND OF THE INVENTION

In commonly owned U.S. Pat. No. 3,680,344 there has been disclosed a rectangular basin or soaking pit in which several parallel beams are disposed below the liquid level and are formed with upstanding stakes or rack teeth defining between them the soaking compartments or bays in which the slabs can be deposited on the underlying beams. A railborne transport mechanism comprises a pair of transporters or cranes each including a bridge or traverse spanning the pit, the cranes being provided with hoists for lowering a slab into a bay and extracting it therefrom after cooling. Each hoist comprises a slab holder in the form of a bracket, suspended from a pulley block, that embraces the slab between two vertical walls and is provided at its bottom with an upwardly retractable latch member on which the slab rests before being deposited on the beams of the pit.

In another commonly owned U.S. Pat. No. 3,895,498, a double slab gripper has been described in which two downwardly open pockets can be simultaneously aligned with adjacent soaking compartments in order to enable a hot slab, carried in one of the pockets, to be lowered into one of these compartments whereupon a previously cooled slab, entering the other pocket during the lowering operation, can be extracted from the adjoining compartment. The pockets can be alternately closed at the bottom with the aid of one or more retractable latch members.

While these prior systems operate generally satisfactorily, their hoisting mechanisms are relatively bulky inasmuch as three vertical wall members are required therein to form the two slab-receiving pockets. The hoist drive, accordingly, must be capable of lifting the weight of the heavy gripper structure in addition to that of the engaged slab or slabs.

OJECT OF THE INVENTION

The object of our present invention, therefore, is to provide an improved apparatus of the aforedescribed type in which the dead weight of the gripper mechanism is significantly reduced.

SUMMARY OF THE INVENTION

We realize this object, in accordance with the present invention, by the provision of first and second guide means fixedly depending from the traverse of the transporter at locations which are separated in the direction of travel by a distance substantially equaling twice the spacing of the stakes rising from the beams of the pit, the traverse being further provided with vertically movable gripper means bracketed by the first and second guide means and defining therewith a pair of carrying cages alignable with two adjoining soaking compartments or bays. Thus, in contrast to the aforedescribed pockets, the cages of our improved slab transporter are formed only in part by vertically reciprocable members, namely by the aforementioned gripper means common to both cages, whereas the outer cage walls are secured to the traverse and are therefore vertically immovable.

Advantageously, the guide means forming these outer walls are designed as confronting sets of vertical bars which may be laterally offset from the longitudinal rows of stakes in the pit and in that case may extend downwardly to a level below the tips of the stakes. This insures a smooth transition of the slabs from the cages to the underlying compartments and vice versa. The bars, or some of them, serve for the guidance not only of the slabs but also of two or more carriages forming part of the hoist means, the vertically reciprocable gripper means being a plurality of transversely spaced arms individually or jointly supported by these carriages which are provided with a common drive for synchronous movement. Each of these gripper arms, whose number preferably equals that of the guide bars of each set, has a foot at its lower end serving the same function as the latches our prior U.S. Pat. No. 3,895,498 which are alternately extendable in opposite directions as well as retractable into an inoperative position.

BRIEF DESCRIPTION OF THE DRAWING

The above and other features of our invention will now be described in detail with reference to the accompanying drawing in which.

SPECIFIC DESCRIPTION

Figure 1:
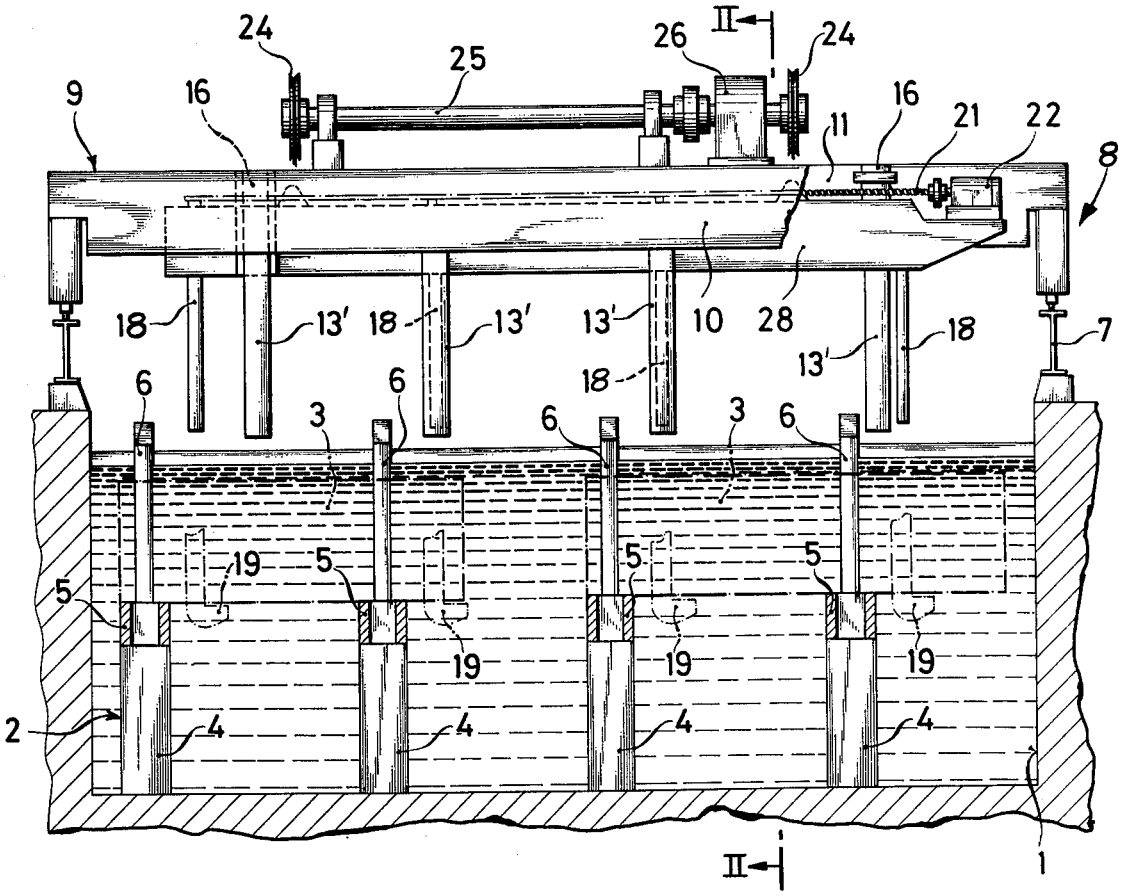
FIG. 1 is a cross-sectional view of a soaking pit spanned by a transporter forming part of our improved slab-cooling apparatus.
Figure 2:
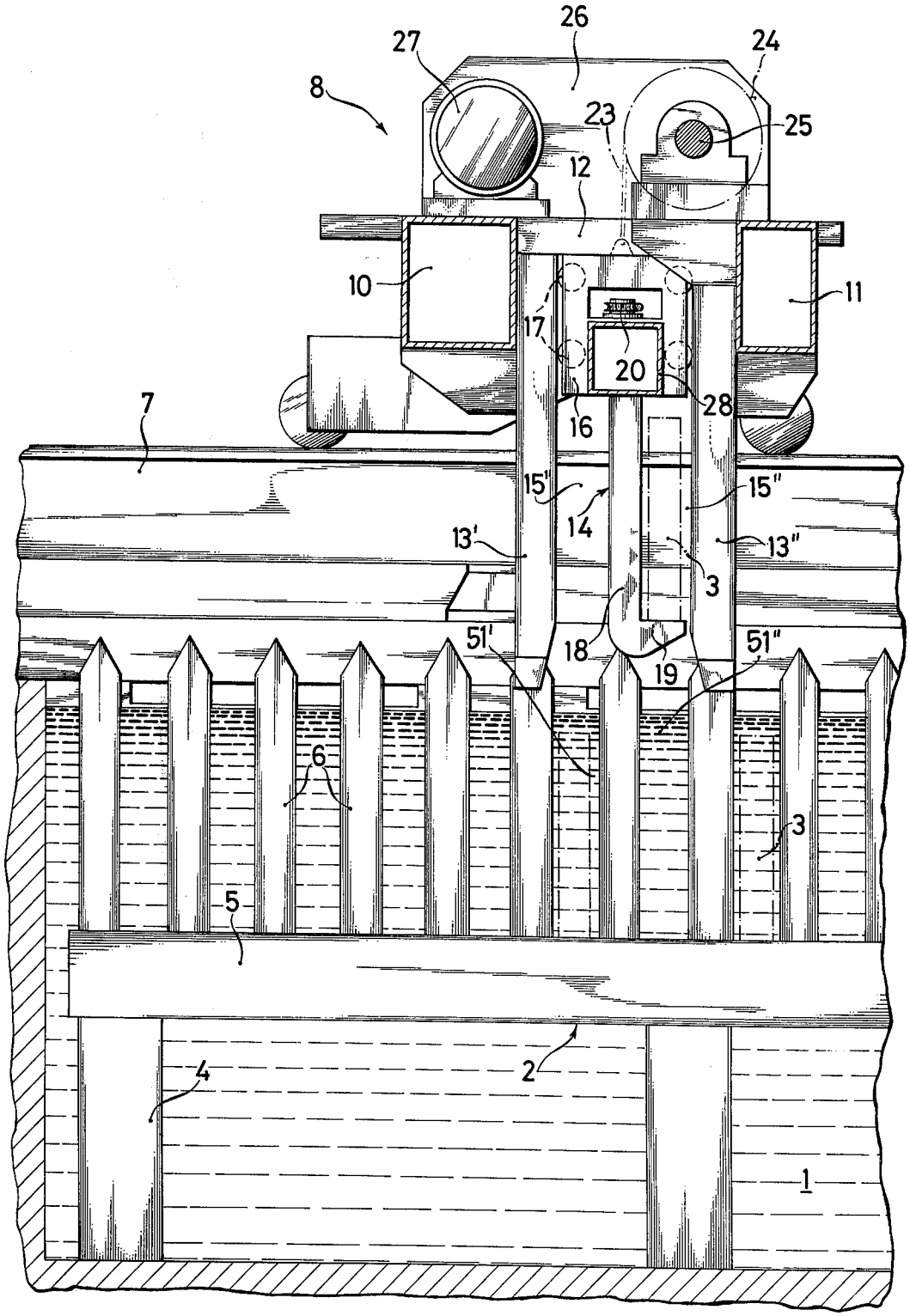
FIG. 2 is a fragmentary cross-sectional view taken on the line II — II of FIG. 1 and drawn to a larger scale.
Figure 3:
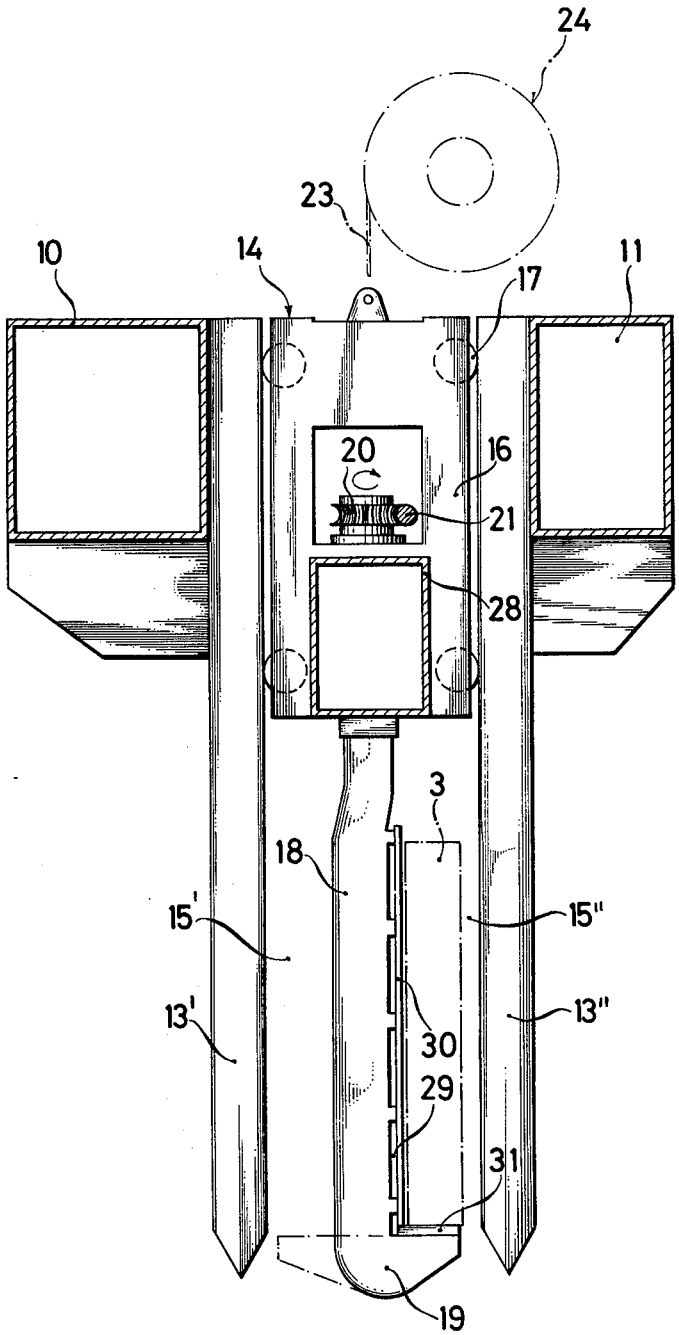
FIG. 3 is a fragmentary cross-sectional view further enlarged to show details of the structure of FIG. 2.

In FIGS. 1 – 3 we have shown a soaking pit 1 of rectangular outline with a submerged supporting structure 2 of four parallel beams 5 resting on posts 4. The beams, extending longitudinally of the pit, carry respective rows of rising rack teeth or stakes 6 whose beveled tips project upwardly above the liquid level and whose spacing in the longitudinal direction slightly exceeds the width of a slab 3 to be received therebetween. The width of the pit is more than twice the length of a slab whereby two such slabs can be deposited side by side on respective pairs of beams 5 within a compartment or bay defined by two groups of aligned stakes 6.

Two rails 7 extending alongside the pit 1, parallel to the beams 5, support a transporter 8 with a traverse or bridge 9, the latter consisting essentially of two parallel hollow girders 10, 11 interconnected by cross-braces 12. Girders 10 and 11 carry respective sets of depending guide bars 13' and 13'' which are laterally offset from the stakes 6 and whose beveled lower ends overlap the beveled tips of the stakes terminating just above the liquid level. A gripper array 14, located midway between guide bars 13' and 13'', defines with these guide bars a pair of cages 15' and 15'' registering with two adjoining soaking compartments 51', 51'' upon alignment of guide means 13', gripper means 14 and guide means 13'' with respective stakes 6.

The gripper array 14 comprises four transversely spaced vertical arms 18 depending from a boom 28 which is rigid with a pair of carriages 16 that are vertically reciprocable between respective guide bars 13' and 13''. Each carriage has two pairs of rollers 17 which engage the adjoining guide bars 13', 13'' for up-and-down movement therealong. The carriages are suspended from chains 23 which pass around sprockets 24 on a common shaft 25 driven by a hoist motor 27 via a transmission 26. From FIG. 1 it will be noted that the arms 18 are not necessarily in line with guide bars 13', 13''; they are, however, also offset from the stakes 6.

Each gripper arm 18 is integral with a foot 19 adapted to be lowered, as diagrammatically illustrated in FIG. 1, beneath the level of the upper beam surfaces on which hot slabs 3, coming from a rolling mill, are deposited within the pit 1. Each arm 18 is rotatably journaled in the boom 28 and carries a worm gear 20 meshing with a worm 21 common to all the gripper arms. Worm 21 is driven by a motor 22 which is reversibly energizable to turn the feet 19 through 180° between two working positions and a retracted position. In one of these working positions, shown in full lines in FIGS. 2 and 3, the foot 19 of each arm extends across the bottom of cage 15" in order to support a pair of slabs between these arms and the guide bars 15''; in their diametrically opposite alternate working position, illustrated in dot-dash lines in FIG. 3, the feet 19 extend across the bottom of cage 15' whereby slabs can be similarly supported between arms 18 and guide bars 13'. In their intermediate, retracted position, indicated diagrammatically in FIG. 1, the feet 19 lie in a median transverse plane parallel to the sets of guide bars 18' and 13'' so that both cages are downwardly open for respectively depositing two hot slabs in the pit and receiving two cooled slabs to be transported to a further destination, as described in the prior patents identified above.

As further shown in FIG. 3, each arm 18 is formed on the side of its foot 19 with a number of surface recesses 29 overlain by a heat shield 30 which separates the arm 18 from the engaged slab 3, the recesses 29 thus forming channels for the circulation of cooling water between the arm and the slab. A refractory plate 31 protects the foot 19 from the heat of the slabs supported thereby.

Figure 4:
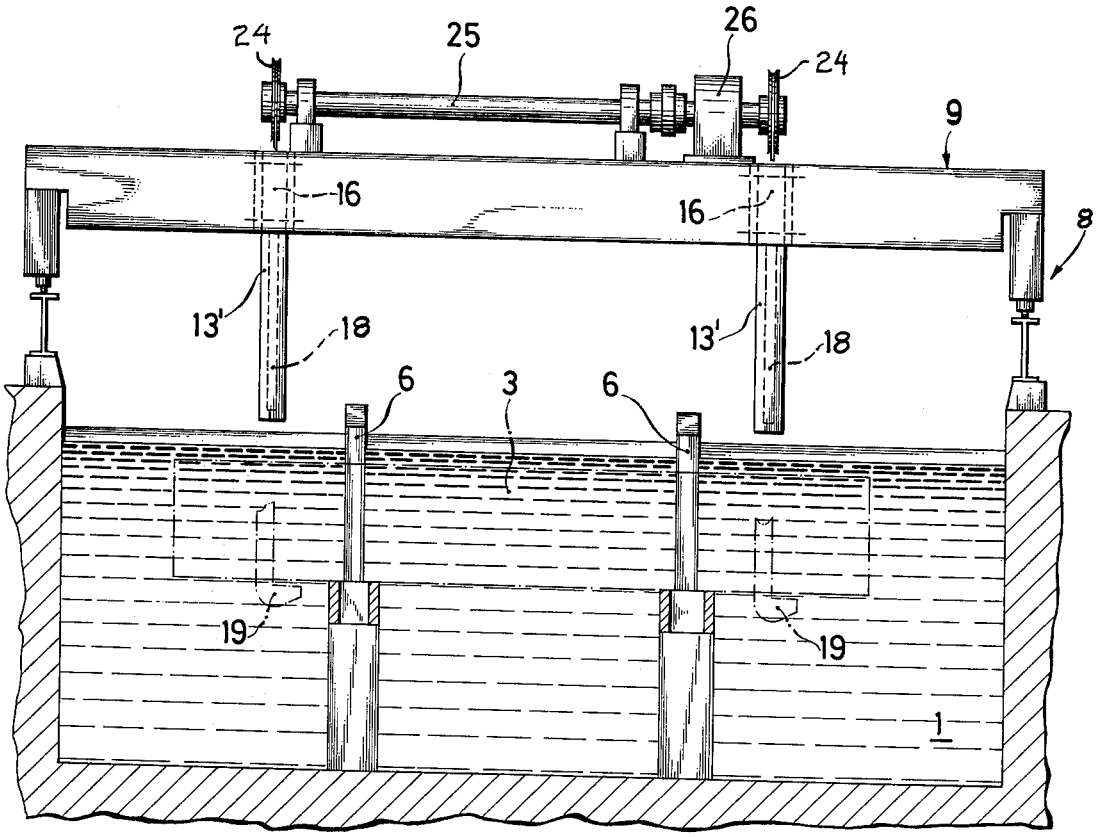
FIG. 4 is a view similar to FIG. 1, illustrating another embodiment.
Figure 5:
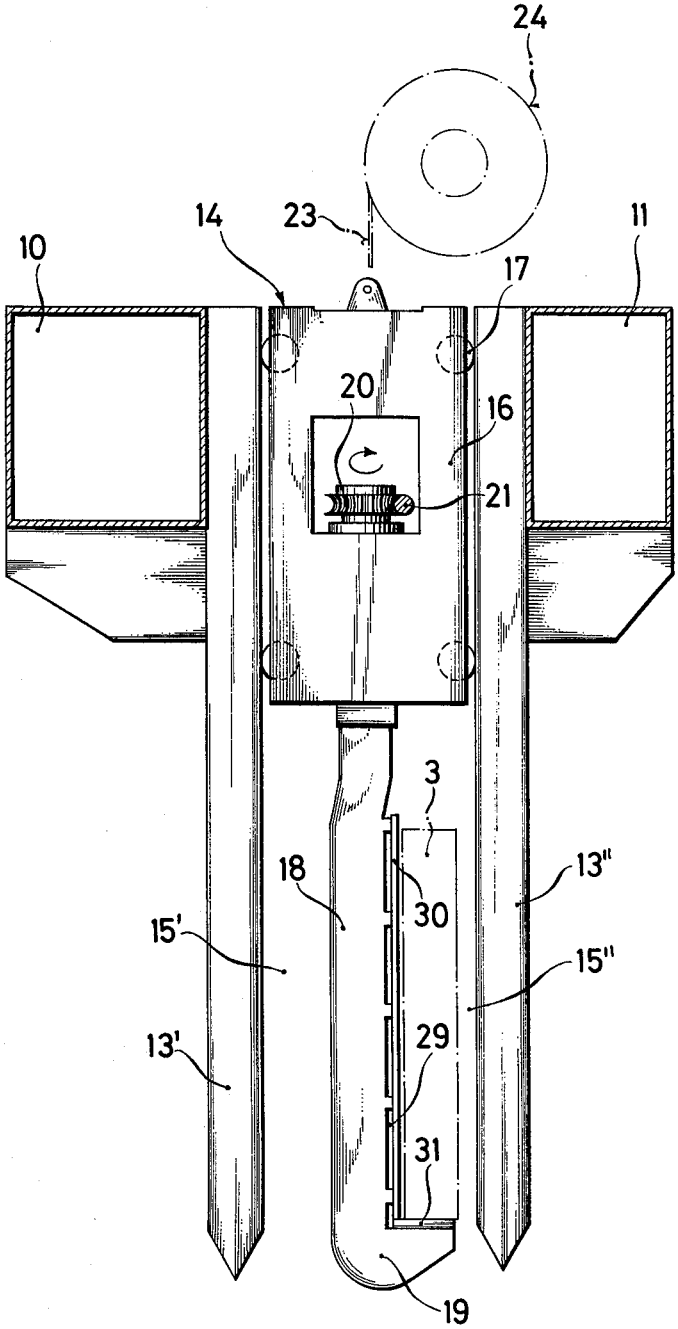
FIG. 5 is a view similar to FIG. 3 but relating to the embodiment of FIG. 4.

In FIGS. 4 and 5 I have shown a modified hoisting mechanism in which the boom 28 has been omitted, each carriage 16 being directly suspended from a cable or chain 23 wound about an associated pulley or sprocket 24. In this instance, with not more than two carriages 16, only one slab 3 can be accommodated in each cage 15', 15''.

Figure 6:
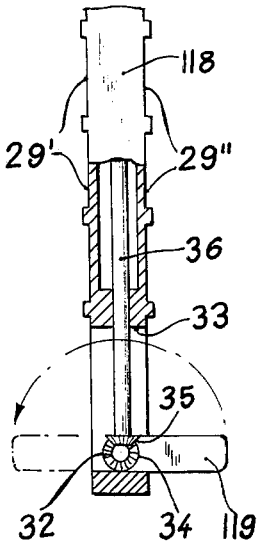
FIG. 6 is a partly sectional detail view illustrating a modification.

The slab-supporting feet 19, rigid with the gripper arms 18, may be replaced by pivoted latch members generally similar to those shown in our prior U.S. Pat. No. 3,895,498. In FIG. 6 we have illustrated a foot 119 fulcrumed on a pin 32 for swinging in a vertical plane through a bottom slot 33 of a nonrotating gripper arm 118. Pin 32 carries a bevel grear 34 in mesh with another bevel gear 35 on a vertical shaft 36 traversing the arm 118, this shaft 36 being rigid with a worm gear such as the one shown at 20 in FIGS. 3 and 5. Thus, motor 22 (FIG. 1) can swing the foot 119 into either of its working positions, illustrated in full and dot-dash lines, as well as into an intermediate inoperative position in which that foot stands erect within slot 33.

Since a hot slab may be carried either to the left or to the right of the nonrotatable gripper arm 118, this arm is shown provided with two sets of recesses 29' and 29'' on opposite sides thereof.

We claim:

1. An apparatus for cooling hot slabs in a soaking pit divided into a plurality of slab-receiving compartments formed by rows of stakes rising from parallel beams within the pit, comprising:

rail means alongside said pit paralleling said beams;

a transporter riding on said rail means, said transporter including a traverse spanning said pit;

first and second guide means fixedly depending from said traverse at locations separated in the transport direction by a distance substantially equaling twice the spacing of said stakes;

vertically movable gripper means on said traverse disposed between said first and second guide means and defining therewith a first and a second carrying cage alignable with a pair of adjoining compartments; and hoist means on said transporter for reciprocating said gripper means between an elevated transport position above said stakes and an immersion position at the level of said beams, said gripper means being provided with retractable slab-supporting means alternately extendable across the bottoms of said cages for depositing a hot slab from said first cage on two of said beams in one compartment and then lifting a cooled slab into said second cage from the other compartment of said pair of adjoining compartments.

2. An apparatus as defined in claim 1 wherein said first and second guide means comprise a set of first vertical bars and a set of second vertical bars confronting each other.

3. An apparatus as defined in claim 2 wherein said vertical bars are laterally offset from said stakes and terminate at a level below the tips of said stakes.

4. An apparatus as defined in claim 2 wherein said hoist means comprises at least two carriages, each engaging a first and second vertical bar for reciprocation therealong, and common drive means for jointly raising and lowering said carriages.

5. An apparatus as defined in claim 4 wherein said gripper means comprises a plurality of transversely spaced arms each supported by at least one of said carriages.

6. An apparatus as defined in claim 5 wherein said hoist means further comprises a transverse spar rigidly interconnecting said carriages, said arms being mounted on said spar.

7. An apparatus as defined in claim 6 wherein said arms number at least four for carrying two slabs alongside each other.

8. An apparatus as defined in claim 5 wherein said slab-supporting means comprises a foot at the lower end of each arm, said feet being provided with common control means for selective displacement between two alternate extended positions and a retracted position.

9. An apparatus as defined in claim 8 wherein said arms are rotatable about respective vertical axes, said feet being rigid with said arms and being retractable by rotation into a median transverse plane.

10. An apparatus as defined in claim 8 wherein said feet are pivotally mounted on said arms for swinging relatively thereto between said extended and retracted positions.

11. An apparatus as defined in claim 5 wherein each of said arms is provided with water-circulating recesses on at least one side thereof.

* * * * *